US005457642A

United States Patent [19]

Brookner

[11] Patent Number: 5,457,642

[45] Date of Patent: Oct. 10, 1995

[54] MAIL PROCESSING SYSTEM INCLUDING REQUIRED DATA CENTER VERIFICATION

[75] Inventor: George M. Brookner, Norwalk, Conn.

[73] Assignee: Pitney Bowes Inc., Stamford, Conn.

[21] Appl. No.: 133,418

[22] Filed: Oct. 8, 1993

[51] Int. Cl.[6] ..... G07B 17/00

[52] U.S. Cl. ..... 364/569; 364/464.02

[58] Field of Search ..... 364/464.02, 569

[56] References Cited

U.S. PATENT DOCUMENTS

| | | | |
|---|---|---|---|
| 3,792,446 | 2/1974 | McFiggans et al. | 340/172.5 |
| 3,978,457 | 8/1976 | Check, Jr. et al. | 340/172.5 |
| 4,097,093 | 6/1978 | Shelby et al. | 305/22 |
| 4,302,821 | 11/1981 | Eckert et al. | 364/464.02 |
| 4,757,537 | 7/1988 | Edelmann et al. | 380/31 |
| 4,787,045 | 11/1988 | Storace et al. | 364/464.02 |
| 4,831,555 | 5/1989 | Sansone et al. | 364/519 |
| 4,833,618 | 5/1989 | Verma et al. | 364/483 |
| 4,864,506 | 9/1989 | Storace | 364/464.02 |
| 4,878,245 | 10/1989 | Bradley et al. | 380/10 |
| 5,243,654 | 9/1993 | Hunter | 380/51 |
| 5,384,708 | 1/1995 | Collins et al. | 364/464.02 |

FOREIGN PATENT DOCUMENTS 2251210 1/1992 United Kingdom .

*Primary Examiner*—Edward R. Cosimano

*Attorney, Agent, or Firm*—Charles R. Malandra, Jr.; David E. Pitchenik; Melvin J. Scolnick

[57] ABSTRACT

An improvement to a postage evidencing apparatus of the type having computer structure and a printer commanded by the computer for printing an indicia for indicating the amount of dispensed postage on a mailpiece. The improvement includes a clock connected to the computer for determining elapsed time between contacts with a data center. The computer including control structure for disabling printing of the indicia and printing a legend in place thereof whenever postage dispensing is attempted in the event that more than a predetermined amount of time has elapsed without contacting the data center.

3 Claims, 2 Drawing Sheets

MAIL PROCESSING SYSTEM INCLUDING REQUIRED DATA CENTER VERIFICATION

FIELD OF THE INVENTION

The invention relates to mail processing systems and more particularly to security of postage metering systems.

BACKGROUND OF THE INVENTION

Recent advances in digital printing technology have made it possible to implement digital, i.e., bit map addressable, printing for the purpose of evidencing payment of postage by a postage-meter-like device. The computer driven printer can print the postal indicia in a desired location on the face of a mail piece. As used herein the postal indicia may include a Postal Revenue Block or PRB. The PRB typically contains data such as the postage value, a unique identification number, the date and in some applications the name of the place where the mail is originating. In order to distinguish a postage-meter-like device from a conventional postage meter, it will be called herein a Postage Evidencing Device or PED.

From the Post Office's point of view, it will be appreciated that the use of such digital printing makes it fairly easy to counterfeit the PRB since any suitable computer and printer may be used to generate multiple images.

Many of these new PED systems will be using printers that can print otherwise legitimate indicia that are indistinguishable from others that are simply being used without any attempt to purchase postage and will be used for other purposes as well. A typical situation might occur where a mailer closed or went out of business without notifying the manufacturer or returning the PED or the computer and printer may be sold. The further use of the meter would be outside postal regulations but such use may be difficult to easily spot during high speed processing of the mail stream.

U.S. Pat. Nos. 4,864,506 and 4,787,045 describe a postage meter system connected to a telephone line which will not print postage after the meter has been without power for a preset length of time. The meter may be reset by a telephone connection or may be locked out and require the operator to take the meter to the Post Office for revalidation. The meter may also be taken out of service by communication with a data center.

U.K. 2,251,210A to Gilham describes a meter that contains an electronic calendar to inhibit operation of the franking machine on a periodic basis to ensure that the user conveys accounting information to the postal authorities.

While the foregoing systems operate to assure that the meter will not allow postage to be printed, there is nothing that will necessarily alert the user to the status of the PED.

SUMMARY OF THE INVENTION

It is an object of the invention to aid in assuring that postage evidencing devices are being used legitimately while allowing other uses of the user's computer and printing system.

It is another object to assure that postage evidencing devices are properly returned to the manufacturer when use of the device is discontinued by the mailer.

It has been found that one way to aid in prevention of fraud for the Postage Evidencing Devices is to require that the devices which are in place have a time delay (time out) such that unless data center contact has occurred within a predetermined period of time, the device will cause to be printed only a message that requires the user to take some action instead of allowing franking to take place. In a preferred embodiment the postage evidencing device would print a legend, for example, but not as a limitation, "THIS DEVICE WILL NOT DISPENSE POSTAGE. CALL PITNEY BOWES."

Thus the above and other objects are attained in a novel postage evidencing apparatus of the type having computer means and a printer commanded by the computer for printing an indicia for indicating the amount of dispensed postage on a mailpiece, the improvement comprising a clock means connected to the computer means for determining elapsed time between contacts with a data center and said computer means including means for disabling printing of the indicia and printing a legend in place thereof whenever postage dispensing is attempted in the event that more than a predetermined amount of time has elapsed without contacting the data center.

In a preferred embodiment, the indicia is changed to indicate that a particular action must be taken whenever the predetermined time has elapsed.

In another aspect the invention is a method for operating a postage meter comprising the steps of enabling operation of the postage meter by contacting a data center, determining the elapsed time of postage meter operation after contact with the data center, comparing the elapsed time after enabling postage meter operation to a selected time interval, and thereafter causing the postage meter to print a message indicating an action to be taken while disabling the postage meter from printing the indicia in the event that the elapsed time interval exceeds the selected time interval.

DESCRIPTION OF THE PREFERRED EMBODIMENT

Figure 1:
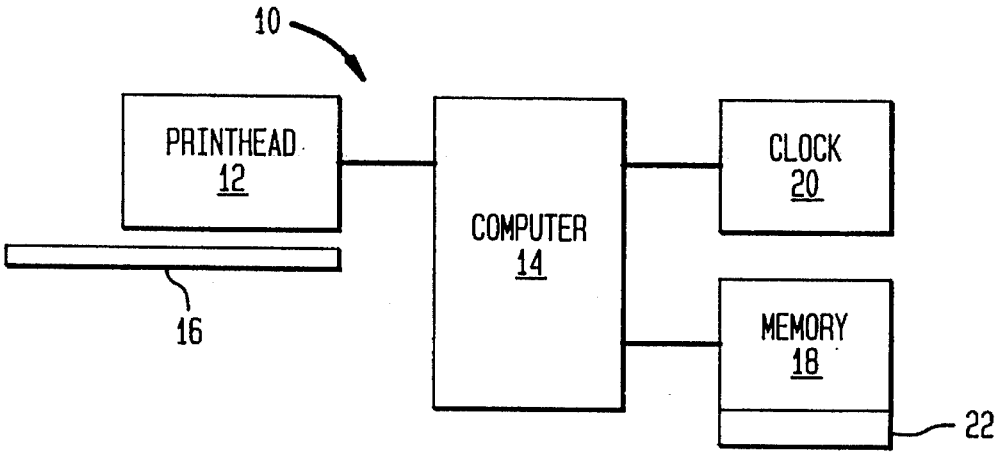
FIG. 1 is a schematic view of a system which may be used in accordance with the invention.
Figure 3A:
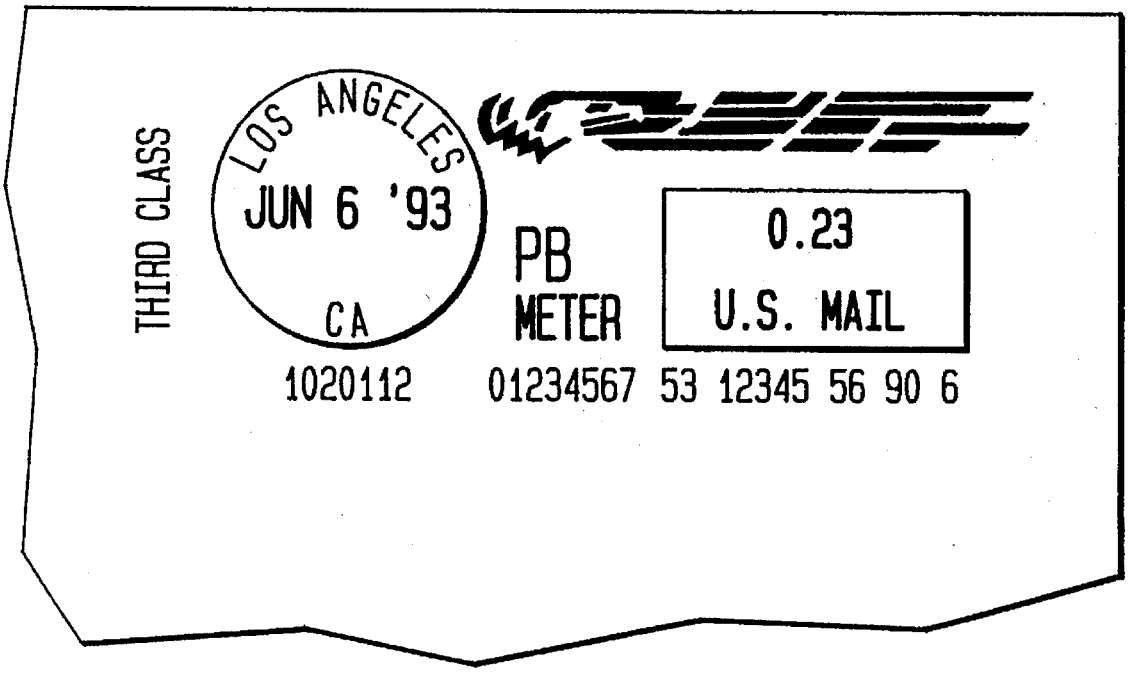
FIGS. 3*a* and 3*b* illustrate, respectively, a typical indicia and the alternate in accordance with the invention.

In FIG. 1, there is shown generally at 10 a system in accordance with the invention. The system comprises a printhead 12 and associated computer means 14 suitably programmed for driving the printhead for printing an indicia (not seen in FIG. 1) on a mailpiece indicated at 16. Memory 18 stores therein among the other items a bit-map image of at least one appropriate indicia image for printing by the printhead 12 which is suitably connected to computer 14 in known manner as described for example in U.S. Pat. No. 4,757,537 to Edelmann et al. or U.S. Pat. No. 4,831,555 to Sansone et al., specifically incorporated by reference herein. Alternatively, the printing device may be as disclosed in U.S. Pat. No. 5,390,251, assigned to the assignee of the instant application and specifically incorporated by reference herein. A typical indicia is indicated in FIG. 3*a*.

As is well known, the postage meter operation includes printing and accounting for the value printed in the indicia and the actual operation will not be further described herein.

Clock 20 is connected to input time data to the computer means 14 where it is compared to the selected elapsed time (indicated at block 22) stored in memory 18. The elapsed time may be selected to be any desired elapsed time determined from the parameters of operation of the meter. The object is to assure that there is contact between the meter user and the data center on a regular basis. The clock may be reset upon contact with the data center, preferably through use of a code provided by the data center.

Figure 2:
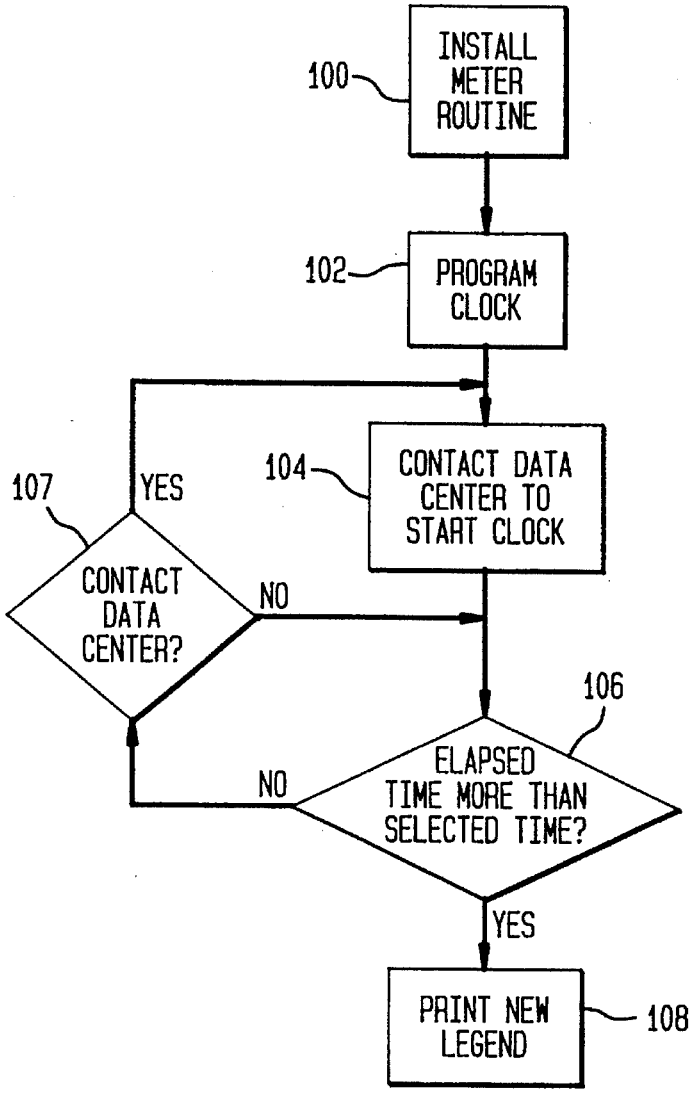
FIG. 2 is a flow chart of the operation of the apparatus in accordance with the invention.
Figure 3B:
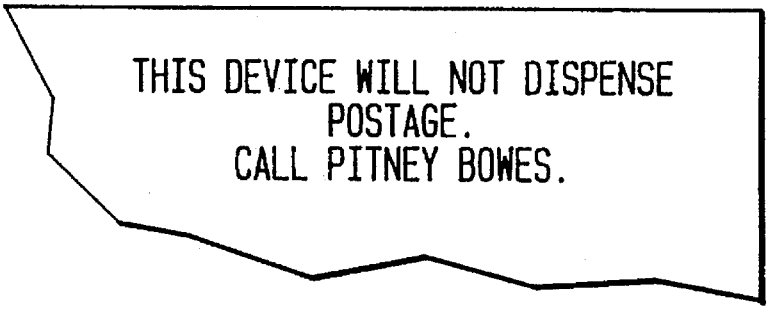

FIG. 2 is a flow chart of the operation of the meter in accordance with the invention. The meter is installed at block 100 and the clock is programmed at block 102. Contact with the data center, block 104, starts the elapsed time to start and enables the meter. A check is made, decision block 106, to compare the elapsed time with the selected time input to the meter. While the elapsed time is less than the selected time the meter continues to be enabled. Subsequent action by the user to contact the data center, block 107, will cause the reset the elapsed time interval. However, in the event that the elapsed time exceeds the selected time, the YES path from decision block 106 causes the printer to print a new legend, block 108, in place of the indicia. The legend may be, for example, as shown in FIG. 3*b*.

What is claimed is:

1. In a postage evidencing apparatus of the type having computer means and a printer commanded by the computer for printing an indicia for indicating the amount of dispensed postage on a mailpiece, the improvement comprising a clock means connected to the computer means for determining elapsed time between contacts with a data center and said computer means including means for disabling printing of the indicia and printing a legend in place thereof whenever postage dispensing is attempted after a predetermined amount of time has elapsed without contacting the data center.

2. The apparatus of claim 1 wherein the meter indicia is changed to indicate that a predetermined action must be taken.

3. A method for operating a postage meter comprising the steps of enabling operation of the postage meter by contacting a data center, determining the elapsed time of postage meter operation after contact with the data center, comparing the elapsed time after enabling postage meter operation to a selected time interval, and thereafter causing the postage meter to print a message indicating an action to be taken while disabling the postage meter from printing the indicia in the event that the elapsed time interval exceeds the selected time interval whenever postage dispensing is attempted after a predetermined amount of time has elapsed without contacting the data center.

* * * * *